United States Patent [19]

Davis

[11] Patent Number: 4,842,543

[45] Date of Patent: Jun. 27, 1989

[54] CONTACT PROTECTION SYSTEM FOR ELECTRICAL CONNECTORS

[75] Inventor: Wayne S. Davis, Harrisburg, Pa.

[73] Assignee: AMP Incorporated, Harrisburg, Pa.

[21] Appl. No.: 202,075

[22] Filed: Jun. 3, 1988

[51] Int. Cl.[4] ..... H01R 13/645

[52] U.S. Cl. ..... 439/378; 439/374; 439/904; 439/246

[58] Field of Search ..... 439/350, 374, 376, 378, 439/380, 674, 677, 678, 679, 680, 681, 362, 712, 713, 715, 901, 902, 903, 904, 906, 34, 246–248

[56] References Cited

U.S. PATENT DOCUMENTS

| | | | |
|---|---|---|---|
| D. 200,645 | 3/1965 | Schumacher | D13/24 |
| D. 271,685 | 12/1983 | Cosciotti et al. | D13/24 |
| D. 271,686 | 12/1983 | Casciotti et al. | D13/24 |
| 2,746,022 | 5/1956 | Gilbert | 439/363 |
| 2,902,665 | 9/1959 | D'Amico | 439/363 |
| 3,177,461 | 4/1965 | Hagen et al. | 439/681 X |
| 3,582,867 | 6/1971 | Thompson et al. | 439/362 |
| 3,611,272 | 10/1971 | Fairbairn et al. | 439/681 |
| 3,714,617 | 1/1973 | Bright et al. | 439/681 |
| 4,224,486 | 9/1980 | Zimmerman | 200/51.1 |
| 4,277,126 | 7/1981 | Lincoln | 439/681 |
| 4,647,130 | 3/1987 | Blair et al. | 439/248 |

FOREIGN PATENT DOCUMENTS

| | | | |
|---|---|---|---|
| 792386 | 12/1980 | U.S.S.R. | 439/681 |

OTHER PUBLICATIONS

AMP Instruction Sheet IS9163 Released 11-19-86.

AMP Document Entitled "Drawer Connectors".

AMP Document Entitled "AMP-HDI 2Pc PC BD Connectors".

AMP Document Entitled "AMP-HDI Hybrid Connectors".

AMP Document Entitled "Designer Digest 45".

*Primary Examiner*—Eugene F. Desmond

*Assistant Examiner*—Stephen Zagrobelny

*Attorney, Agent, or Firm*—David L. Smith

[57] ABSTRACT

A connector (12) or a pair of connectors (10,12) having a removable post (105) for reception in a channel (51) in an electrical connector (12) wherein the channel (51) has a wider first region (54) and a narrower second region (56), with the narrower second region (56) opening both onto the wider first region (54) and an exterior surface (57) of the connector (12). The post (105) has an elongate body section (106) that is an enlarged retaining portion adapted to be slidingly received in the wider first region (54) of channel (51). Elongate body section (107) has a first portion (108) and an extended portion (110). First portion (108) is typically narrower than extended portion (110), is adjacent to and extends from the enlarged body section (106) and is adapted to extend through the narrower region (56) of channel (51) to interconnect the enlarged body section (106) with extended portion (110). Extended portion (110) is received axially in a passage of a complementary connector (10) when properly aligned therewith for mating of the connectors. Posts (105) function as spacers to prevent contacts of one connector from moving across and impinging against features extending from the mating face of the complementary connector, thereby avoiding damage to the contacts.

18 Claims, 4 Drawing Sheets

CONTACT PROTECTION SYSTEM FOR ELECTRICAL CONNECTORS

BACKGROUND OF THE INVENTION

The present invention relates generally to electrical connectors and, more particularly, to a contact protection system for electrical connectors.

Electrical connectors are frequently provided with keying means to permit particular pairs of connectors to properly mate and to prevent the mating of connectors which are not intended to be mated. Keying means are especially useful when a plurality of identical connectors are positioned in close proximity to one another, for example, on a printed circuit board. The incorrect matching of complementary connectors to the connectors on the board can cause serious damage to the circuits improperly connected thereby; and the keying means, by insuring that each complementary connector will mate with only the correct one of the plurality of connectors on the board, minimizes the risk of improper connection. Keying means are particularly important when the connections are made by untrained personnel as the risk of improper connection is especially great in such circumstances.

Commonly assigned U.S. patent application Ser. No. 07/090,294 filed on Aug. 31, 1987, discloses a pair of complementary electrical connectors which are adapted to be mated to complete electrical circuits through the connectors. The connectors are of the high density type and include a receptacle connector which is adapted to be mounted to a printed circuit board, and a complementary plug connector which is adapted to terminate an electrical cable. The connectors also include a keying system comprising a pair of keys extending from the mating face of each connector. Each key is secured in its connector in a selected angular orientation with respect to an opposing key on the other connector so that when the connectors are intended to be mated, extended keying sections on the keys pass by each other during mating to allow the connectors to properly mate. If one of the keys is secured in an incorrect orientation with respect to its opposing key, however, the extended keying sections on the keys will abut one another during mating to prevent proper mating of the connectors.

The keying system incorporated in the connectors disclosed in U.S. application Ser. No. 07/090,294 is quite effective in applications in which it is desired to insure that a connector will mate with only the correct one of a plurality of complementary connectors. In other applications, however, the keying system is not required; and the connectors are designed to be readily usable in such applications as well. In particular, each key in the keying system comprises a separate component and is mounted to its respective connector by being supported in a passageway which extends into the connector from the mating face thereof. To use the connectors without the keying system, the keys are simply omitted from the connectors.

When the connectors disclosed in U.S. application Ser. No. 07/090,294 are used without the keys mounted thereon, however, it has been found that substantial care must be exercised during mating of the connectors. In particular, the receptacle connector mounted on the printed circuit board includes a number of features which project upwardly from the mating face thereof. These features include latching features for use in latching the connectors together after mating, and features used to retain the keys in the connector in a selected angular orientation and to provide the connector with a further keying capability. Unless care is exercised during the mating process, the pin contacts on the cable terminating plug connector can pass over and impinge against one or more of the projecting features on the receptacle connector as the connectors are being aligned for mating, and be bent or otherwise damaged thereby.

SUMMARY OF THE INVENTION

The present invention provides a contact protection system for electrical connectors that significantly reduces the risk of contact damage during mating of the connectors. The contact protection system comprises a first connector having a plurality of first passageways extending thereinto from a mating face thereof and first electrical contact means; a second connector complementary with the first connector and having a plurality of second passageways extending thereinto from a mating face thereof and second electrical contact means which are adapted to engage the first electrical contact means of the first connector when the connectors are mated, the plurality of first passageways being aligned with the plurality of second passageways when the connectors are mated; and an elongated post removably mounted in each of the plurality of first passageways, each of the elongated posts including an extended portion extending outwardly of a first passageway beyond the mating face of the first connector and being adapted to be received within an aligned second passageway in the second connector during mating of the connectors to permit the connectors to be mated while preventing the contact means of a connector from moving across and impinging against features extending from the mating face of the other connector during mating of the connectors.

In accordance with the invention, the elongated posts on the first connector function as spacers to insure that the contact means on a connector will clear and not impinge against any features extending from the mating face of the other connector as the connectors are being aligned during the mating process. When the connectors are in alignment, however, the extended portions of the posts will enter into the aligned passageways in the second connector to permit the connectors to be properly mated. The posts thus also assist in aligning the connectors during mating.

In accordance with a presently preferred embodiment, the first connector comprises the cable terminating plug connector disclosed in U.S. application Ser. No. 07/090,294, and the plurality of first passageways comprises a pair of slots normally provided in the lower backshell of the connector to support a pair of keys of a keying system therein. The slots comprise generally T-shaped slots and each includes an enlarged first slot portion and a second slot portion of reduced size extending from the enlarged slot portion to an end face of the lower backshell. Each post comprises an elongated, generally T-shaped member having an enlarged, polygonal-shaped section adapted to be received within the enlarged slot portion, and an elongaged body section of generally cylindrical cross-section which includes a first portion which is adapted to be received in the second slot portion and a second, extended portion which is adapted to extend outwardly of the slot beyond the end face of the lower backshell.

The second connector comprises the board-mounted receptacle connector of U.S. application Ser. No. 07/090,294, and the plurality of second passageways comprises a pair of passageways normally provided therein to support a pair of keys of the keying system.

During alignment of the connectors during the mating process, the posts maintain the tips of the pin contacts on the plug connector spaced from any surface features on the receptacle connector to prevent the contacts from impinging against and being damaged by the surface features. When the connectors are properly aligned for mating, however, the extended portions of the posts enter into the second passageways in the receptacle connector to permit the connectors to mate.

The posts are removably mounted to the plug connector by a pair of projections which extend from the inside surface of a cover for the lower backshell and which are normally used to lock keys in the slots when keying system is incorporated into the connectors. When the cover is affixed to the lower backshell, the projections extend into the slots and cooperate with the first portion of the elongated body section of the posts to lock the posts in the connector. The posts can be removed from the connector by simply removing the cover and slipping the posts out of their respective slots.

By the present invention, a contact protection system for electrical connectors is provided which can be incorporated into a connector without modification of the connector itself. The posts can be manufactured in large quantities at low cost and are easily mounted to a connector in a removable manner to provide the customer with substantial flexibility in adapting the connector for use in different applications.

Further advantages and specific details of the invention will become apparent hereinafter in conjunction with the following detailed description of a presently preferred embodiment.

DETAILED DESCRIPTION OF THE PREFERRED EMBODIMENT

Figure 1:
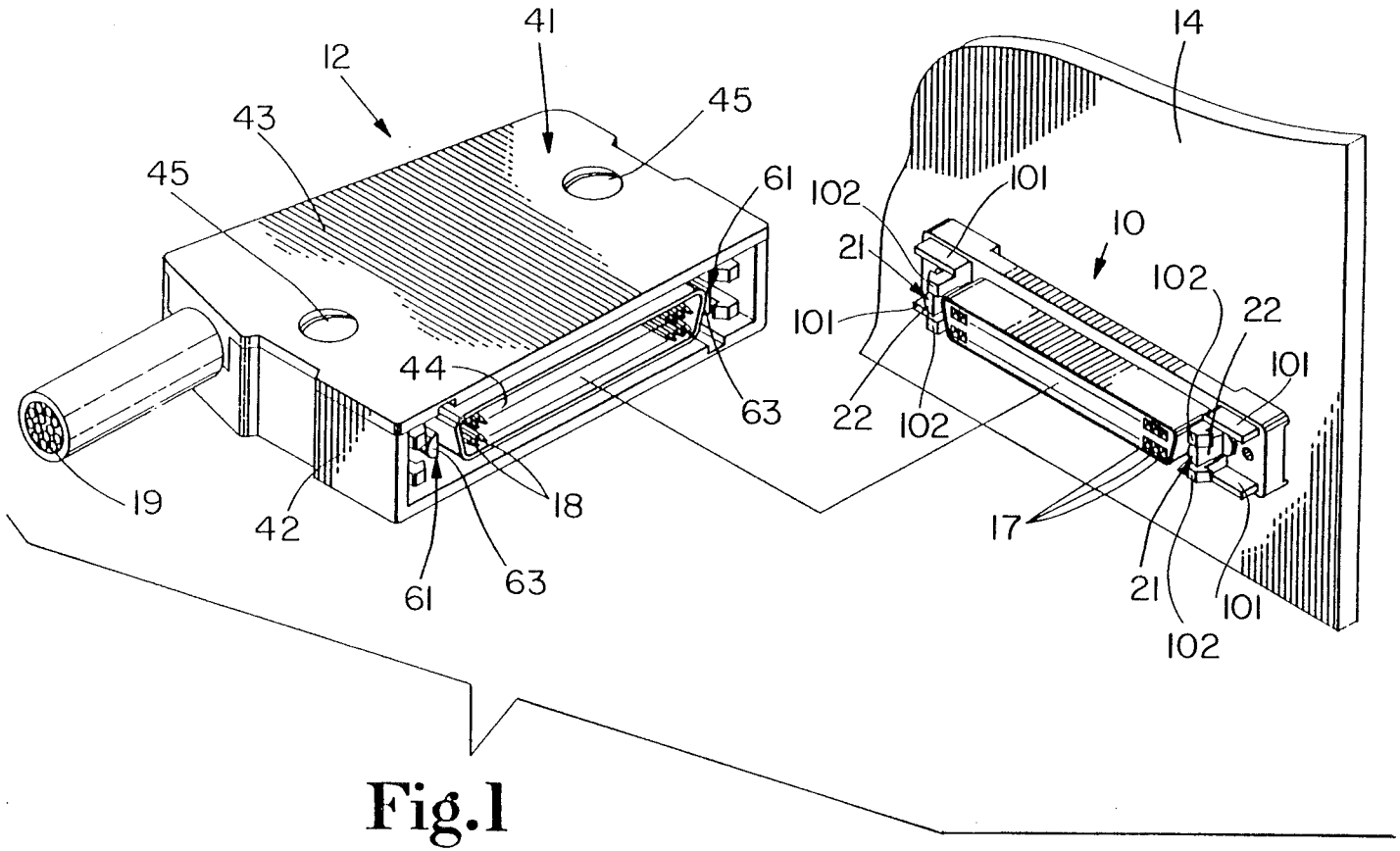
FIG. 1 is a perspective view of a pair of complementary electrical connectors incorporating a keying system to facilitate an understanding of the contact protection system of the present invention.

FIG. 1 illustrates a pair of complementary electrical connectors 10 and 12 of the high density type containing two rows of electrical contacts which are adapted to be mated to complete a plurality of electrical circuits through the connectors.

Connector 10 is designed to be mounted to a printed circuit board or other panel designated by reference numeral 14, and comprises a vertically oriented receptacle connector having a plurality of female contacts 17.

Connector 12 is a cable-terminating connector and comprises a right angle plug connector having a plurality of male pin contacts 18 which are adapted to be electrically connected to external circuitry via cables 19. The embodiment illustrated and described herein is intended to be exemplary only. Either connector can comprise vertically oriented or right angle connectors, and either can be of the plug or receptacle type as required for a particular application.

Connectors 10 and 12 are frequently used in applications in which a plurality of identical connectors are mounted in close proximity to one another. For example, printed circuit board 14 can comprise a panel on a computer or the like and contain a plurality of connectors 10 to permit various external equipment to be connected to the computer via a plurality of complementary connectors 12 coupled to the external equipment. In such applications, it is important to ensure that each connector be mated with the correct complementary connector as mismatching connector pairs can result in damage to the electrical circuits improperly connected thereby.

To ensure that each connector 10 can mate with only the correct complementary connector 12, the connectors include a keying system to prevent incorrect connector pairs from being mated. More particularly, connector 10 includes a pair of keys 21 which include keying sections 22 which can be positioned at any selected one of a plurality of orientations. Connector 12 similarly includes a pair of keys 61 having keying sections 63 which are also positioned in a selected orientation. As is known to those skilled in the art, if the keys of connectors 10 and 12 are properly oriented with respect to one another, the keying sections thereof pass by each other as the connectors are mated permitting the connectors to properly mate. If, however, the keys are not properly oriented with respect to one another, their keying sections will impinge against one another during mating to prevent the connectors from being mated. The keying system thus permits connectors to mate with only the proper complementary connector and not with an incorrect complementary connector.

For the keying system to operate properly during mating of the connectors 10 and 12, it is important that the keys 21 and 61 of the connectors be properly positioned and oriented with respect to one another. If any of the keys rotate or otherwise move to any appreciable extent within their respective connector, the keying system may operate improperly and prevent the proper mating of connectors which are intended to be mated or permit the mating of connectors which are not intended to be mated. Commonly assigned, U.S. patent application Ser. No. 07/090,294 discloses a key retention system for cable-terminating plug connector 12 which is effective in permitting keys 61 to be quickly positioned within connector 12 in a desired orientation and which reliably retains the keys in the selected orientation.

Still referring to FIG. 1, cable-terminating connector 12 includes a housing 41 comprised of a lower backshell 42 and a cover 43 secured thereto by screws 45. A plastic insert 44 is supported within housing 41 and includes a plurality of passageways for supporting the plurality of male pin contacts 18. Cables 19, connected to contacts 18, extend out of the connector through an opening in the lower backshell.

Figure 2:
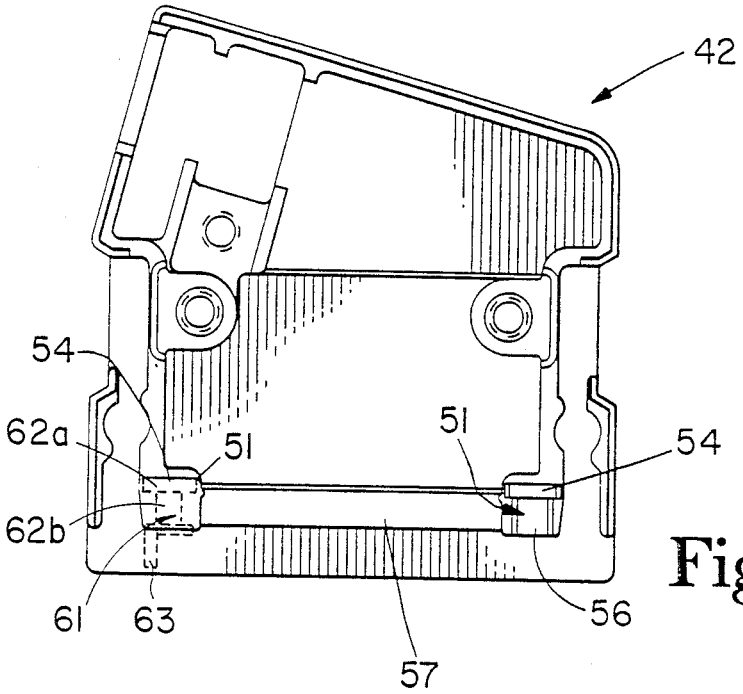
FIG. 2 is a top view of the lower backshell of the cable-terminating connector of FIG. 1.
Figure 4:
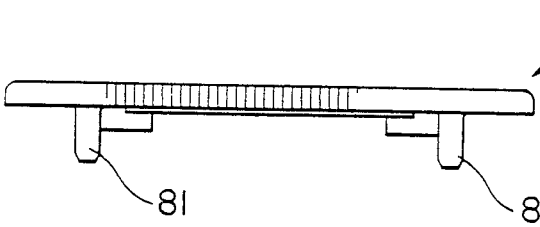
FIG. 4 is a front end view of the cover of the cable-terminating connector of FIG. 1.
Figure 3:
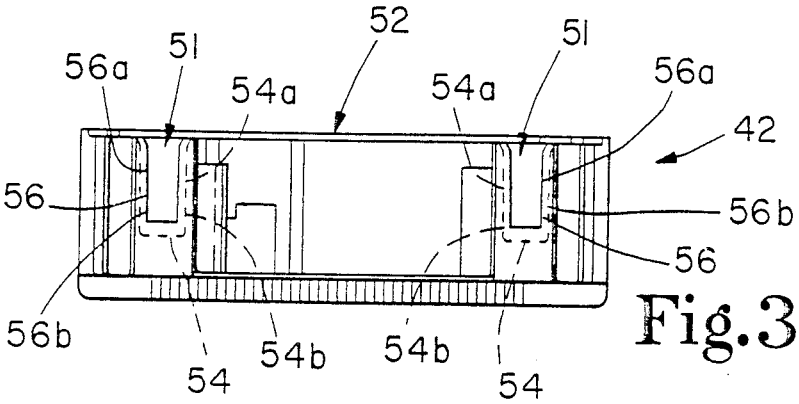
FIG. 3 is a front end view of the lower backshell of FIGS. 1 and 2.

FIGS. 2–4 illustrate cable-terminating plug connector 12 in greater detail. As shown in FIGS. 2 and 3, lower backshell 42 includes a pair of identical slots 51 extending thereinto from substantially opposite sides of the top side face 52 thereof. As shown in FIG. 2, slots 51 have a generally T-shaped configuration when viewed from the top side and include an enlarged first slot portion 54 and a second slot portion 56 of reduced size. Slot portion 54 is both wider and deeper than slot portion 56 as shown in FIG. 3, and slot portion 56 extends from slot portion 54 to the front end face 57 of lower backshell 42.

When viewed from the front end 57 as shown in FIG. 3, the slot portions 54 and 56 are of generally rectangular shape. The side walls of the slot portions 54 and 56, however, include first upper side wall portions **54*a* and 56*a*, respectively, which are tapered inwardly from top surface 52; and second lower side wall portions 54*b* and 56*b***, respectively, which are substantially parallel.

Each slot 51 is normally adapted to receive a key 61 as illustrated in FIG. 1 and in dotted line in FIG. 2. Key 61 is not described in detail herein inasmuch as it is not necessary to a clear understanding of the present invention; but basically comprises an enlarged first body portion **62*a* of polygonal cross-section (e.g., hexagonal cross-section), which is adapted to be received in enlarged first slot portion 54; a second body portion 62*b* of circular cross-section which is adapted to be received in slot portion 56; and a keying section 63 of semi-circular cross-section which is adapted to extend outwardly of slot 51 beyond the front end face 57 to cooperate with the keying section 22 of an aligned key 21 on complementary connector 10**.

A key 61 is adapted to be inserted into a slot 51 from top surface 52 of lower backshell 42 after rotating the key to orient keying section 63 to a desired orientation. After the key is inserted into the slot in the selected orientation, the opposed side faces of the polygonal, enlarged first body portion **62*a* of the key are parallel to the parallel, lower side wall portions 54*b*** of the enlarged first slot portion and fit very closely therebetween such that the key is thereafter prevented from rotating to any appreciable extent within the slot.

When key 61 is inserted into slot 51, the key will be accurately positioned within the slot and be prevented from rotating or moving either laterally or longitudinally within the slot.

The key is locked in position in the slot and prevented from moving up or down within the slot when cover 43 is mounted to lower backshell 42. More particularly, as shown in FIG. 4, cover 43 includes a pair of projections 81 which extend downwardly from the inside surface thereof. When cover 43 is mounted to backshell 42, the projections 81 extend into slots 51 and press against second body portions **62*b* of the keys 61** and lock the keys in the slots and prevent the keys from moving up or down in the slots.

The keying system incorporated in connectors 10 and 12 is quite effective in ensuring that a connector will mate with only the correct one of a plurality of complementary connectors. Connectors 10 and 12 can also be used, however, in applications in which the keying system is not needed. For example, the keying system will normally be unnecessary in applications using only a single pair of complementary connectors 10 and 12. In other applications, hermaphroditic keying means also incorporated into the connectors may provide sufficient keying capability (The hermaphroditic keying means is described in detail in commonly assigned copending U.S. patent application Ser. No. 07/090,293.).

Connectors 10 and 12 can be used in applications which do not require a keying system by simply omitting or removing keys 21 and 61 from their respective connector. When using connectors 10 and 12 without keys 21 and 61, however, substantial care must be exercised during mating of the connectors to insure that the rather delicate pin contacts 18 in plug connector 12 are not damaged. In particular, receptacle connector 10 includes several features which project outwardly from the mating face thereof, and without keys in the connectors, the pin contacts 18 can easily pass over and impinge against one or more of these features during the mating process and be bent or otherwise damaged thereby. These surface features include features 101 adjacent each corner of the connector which are used to retain keys 21 in their selected angular orientation and which include the hermaphroditic keying means described above, and latching features 102 for use in latching connectors 10 and 12 after matinq. Features 101 and 102 do not in themselves form a part of the present invention and, thus, are not described in detail herein. Because they project upwardly from the end face of connector 10, however, they can easily damage the delicate pin contacts 18 of connector 12 as connector 12 is moved over connector 10 to align the connectors during the mating process. The problem is particularly acute because the connectors are frequently mated by untrained personnel in a rather careless manner.

The present invention provides a contact protection system which significantly reduces the risk of damage to the pin contacts of cable terminating plug connector 12 during mating with connector 10 by preventing the pin contacts from moving across and impinging against features 101 or 102 during the mating process.

Figure 5:
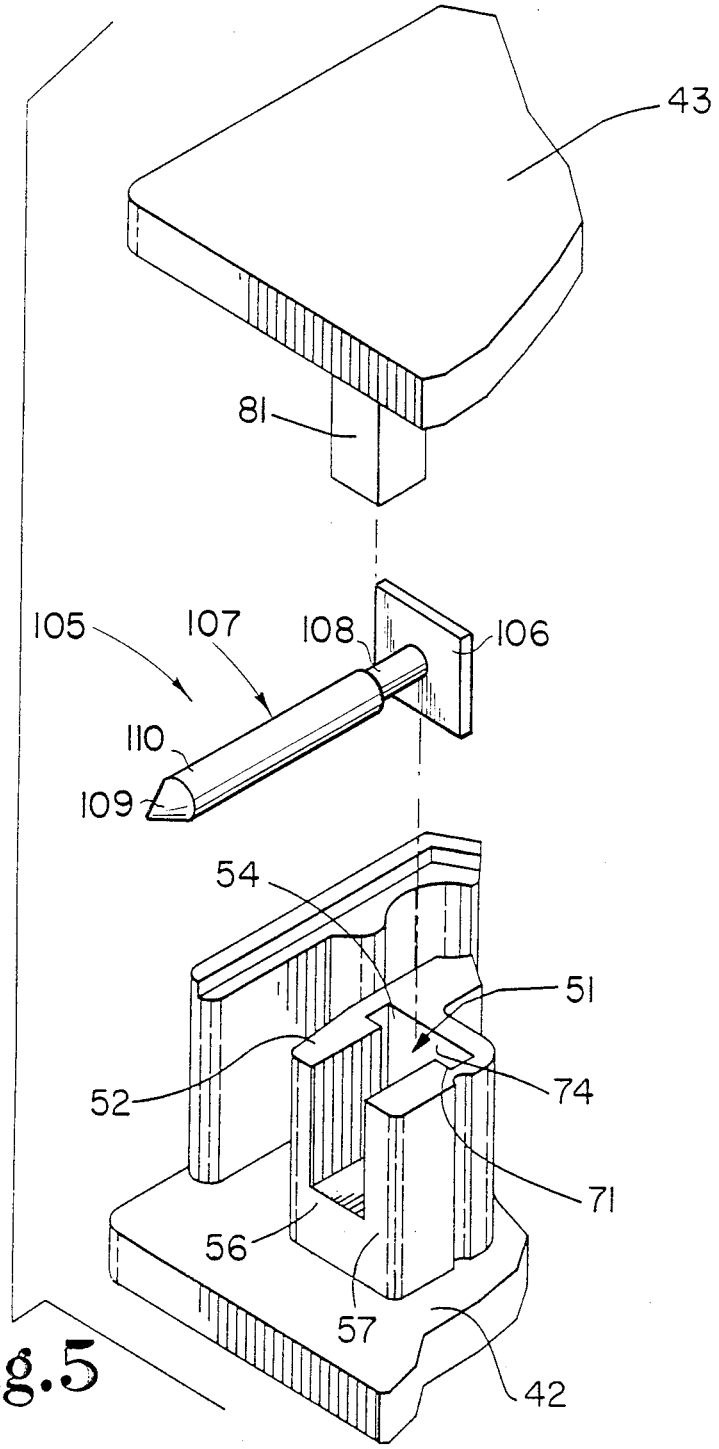
FIG. 5 is an exploded perspective view of a portion of the cable-terminating connector of FIG. 1 incorporating the contact protection system according to a presently preferred embodiment of the invention.
Figure 6:
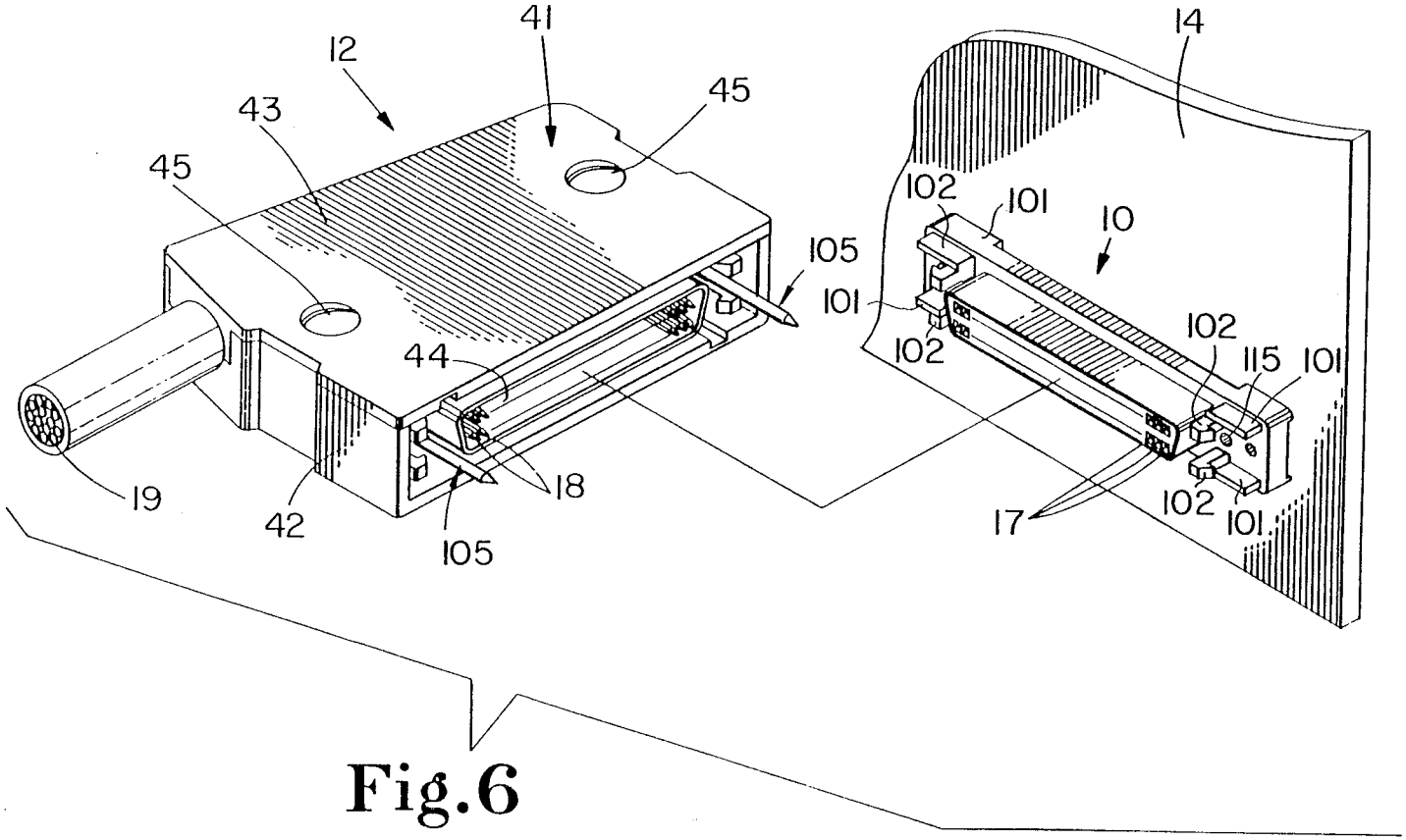
FIG. 6 is a perspective view of the pair of complementary electrical connectors of FIG. 1 incorporating the contact protection system according to a presently preferred embodiment of the invention.

With reference to FIGS. 5 and 6, the contact protection system includes a pair of elongated posts 105 extending from substantially opposite sides of the mating face of connectr 12. The posts 105 are adapted to be received in the T-shaped slots 51 already provided in the lower backshell 42 of connector 12, and include extended portions which extend outwardly beyond the front end face 57 of the lower backshell to function as spacers to prevent the tips of the pin contacts 18 from impinging against the features 101 and 102 on connector 10 during mating. As best shown in FIG. 5, each post 105 comprises a generally T-shaped member having a first, enlarged body section 106 which is adapted to be received in enlarged slot portion 54 of slot 51; and a second elongated body section 107 of reduced size which is adapted to be received in second slot portion 56 and to extend out of the slot beyond the end face 57 of the connector.

Enlarged body section 106 can be of various shapes but is preferably of rectangular shape so as to be received within enlarged slot portion 54 with a rather tight fit. Elongated body section 107 is of a generally circular cross-section and includes a first portion 108 of slightly reduced diameter adjacent to enlarged section 106 which is adapted to be received in second slot portion 56, and a second extended portion 110 which extends outwardly of slot 51 beyond end face 57 as best shown in FIG. 6. The length of extended portion 110 is such that when connectors 10 and 12 are brought together during mating, the outer ends 109 of portions 110 will impinge against the front surface of connector 10 and prevent the pin contacts 18 in connector 12 from impinging against or moving across any of the surface features 101 or 102 of connector 10. The posts, in effect, act as spacers to ensure that the tips of the pin contacts will clear features 101 and 102 as connector 12 is moved across connector 10 to align the connectors for mating. When the connectors are aligned, however, the posts will be aligned with passageways 115 in connector 10 which are provided to normally support the keys 21, and the extended portions 110 of the posts will enter into passageways 115 and permit the connectors to properly mate. The ends of extended portions 110 are preferably tapered as shown at 109 to facilitate insertion of the posts into passageways 115.

To assemble posts 105 to connector 12, the posts are first inserted into slots 51 of the lower backshell from the top surface 52 thereof. Cover 43 is then positioned over the lower backshell and affixed thereto by screws 45 (FIG. 6). When cover 43 is positioned on the lower backshell, projections 81 extending from the inner surface of the cover (and normally provided to lock keys 61 in the connector) extend into slots 51 and press against reduced diameter portions 108 of elongated post sections 110 to lock the posts in the connector and to prevent the posts from moving in the connector.

The present invention thus provides a simple yet highly effective means for protecting the delicate pin contacts of plug connector 12 when connector 12 is mated with receptacle connector 10 in applications in which the keying system is not included in the connectors. The posts 105 are mounted in the slots 51 which are already provided in the lower backshell of connector 12 for the keying system and are received in passageways 115 already provided in connector 10 for the keying system. Thus neither connector 10 nor connector 12 need be modified in any way to incorporate the contact protection system of the invention.

In addition to protecting the pin contacts 18, the posts also assist in aligning the connectors during mating. The posts are also easily removable from connector 12 whenever desired by simply removing cover 43. Connector 12 can thus be easily converted from an unkeyed connector containing posts 105 to a keyed connector containing keys 61 and vice versa whenever desired.

The posts can be manufactured inexpensively of die cast zinc or of any other suitable material, and do not appreciably add to the cost of the connector.

While what has been described constitutes a presently preferred embodiment of the invention, it should be recognized that the invention could take numerous other forms. For example, although the contact protection system has been described primarily in connection with connectors which normally incorporate a keying system therein, the contact protection system can also be used in other connectors in which there is a risk of contact damage during mating. Because the invention can take various forms, it should be understood that the invention is to be limited only insofar as is required by the scope of the following claims.

I claim:

1. A contact protection system for electrical connectors, comprising:

a cable terminating connector having a pair of generally T-shaped slots extending into a lower back shell from a mating face thereof, each of said slots including an enlarged first slot portion and a second slot portion of reduced size extending from said enlarged slot portion to the mating face of said cable terminating connector;

a second connector, said second connector complementary with said cable terminating connector and having a plurality of passageways extending thereinto from a mating face thereof and a plurality of female contacts which are adapted to engage a plurality of male pin contacts of said cable terminating connector when said connectors are mated, said generally T-shaped slots being aligned with said plurality of passageways when said connectors are aligned for mating;

an elongate generally T-shaped post adapted to be removably mounted in each of said T-shaped slots, each of said T-shaped posts includes an enlarged body section of generally rectangular shape adapted to be received within said first enlarged slot portion, and a second elongated body section of generally cylindrical cross-section, said second elongated body section including a first portion adapted to be received within said second slot portion and a second extended portion adapted to extend out of said slot beyond said mating face of said cable terminating connector, said second extended portion being adapted to be received within an aligned passageway in said second connector during mating of said connectors to permit said connectors to be mated, and wherein said posts function as spacers to space the male pin contacts from features extending from the mating face of said second connector to prevent said male pin contacts from moving across and impinging against said features extending from the mating face of said second connector durig mating of said connectors; and a cover for said lower back shell, said cover having a pair of projections extending from the inner face thereof and adapted to extend into said pair of slots when said cover is mounted to said lower back shell, said projections cooperating with said posts for locking said posts in said slots of said cable terminating connector.

2. The contact protection system of claim 1 wherein said first portion of said elongated body section of said posts is of a slightly reduced diameter for cooperating with said projections on said cover for locking said posts in said cable terminating connector.

3. An electrical connector comprising:

a housing having a channel therein, said channel having a wider first region and a narrower second region, said narrower second region opening onto the wider first region and an exterior surface of the housing; and a removable alignment and spacer post defining an axis, said post having an enlarged body section and an elongate body section, said enlarged body section adapted to be slidingly received transverse of said axis in the wider first region of said channel to retain said post in said channel, said elongate body section extending from said enlarged body section, through said narrower second region of said channel and beyond said exterior surface of said housing to space contacts in said connector from features proximate a mating face of a complementary connector when improperly aligned therewith, and adapted to be received in passages of said complementary connector when properly aligned therewith for mating.

4. An electrical connector as recited in claim 3, wherein said elongate body section comprises a narrower first portion for passing through said narrower second region of said channel, and an extended portion for extending beyond said exterior surface.

5. An electrical connector as recited in claim 3, further comprising means for securing said post in said channel.

6. An electrical connector as recited in claim 5, wherein said means for securing the post in said channel comprises a protrusion on a cover, said protrusion adapted to extend into said channel to prevent said post from being removed therefrom when said cover is mounted on the connector housing.

7. An electrical connector as recited in claim 3, wherein said wider first region further comprises opposed side walls which are adapted to cooperate with said enlarged body section of said post to prevent rotation of said post within said channel.

8. An electrical connector as recited in claim 3, wherein said first and second channel regions include lower side wall portions which are substantially parallel to one another, said lower side wall portions of said first region cooperating with opposite sides of said enlarged body section of said post to prevent rotation of said post within said channel.

9. An electrical connector as recited in claim 3, wherein said channel includes curved surface portions for assisting in positioning said post in said channel.

10. An electrical connector as recited in claim 3, wherein said connector includes a pair of spaced channels for receiving a pair of posts therein.

11. An electrical connector, comprising:

a housing having a channel therein, said channel having a wider first region and a narrower second region, said narrower second region opening onto the wider first region and an exterior surface of the housing; and a removable alignment and spacer post defining an axis, said post having an enlarged body section and an elongate body section, said enlarged body section adapted to be slidingly received in the wider first region of said channel, said post axially retained in said channel by engagement of said enlarged body section with opposing wall means of said channel, said elongate body section extending from said enlarged body section, through said narrower second region of said channel and beyond said exterior surface of said housing to space contacts in said connector from features proximate a mating face of a complementary connector when improperly aligned therewith, and adapted to be received in passages of said complementary connector when properly aligned therewith for mating.

12. An electrical connector as recited in claim 11, wherein said elongate body section comprises a narrower first portion for passing through said narrower second region of said channel, and an extended portion for extending beyond said exterior surface.

13. An electrical connector as recited in claim 11, further comprising means for securing said post in said channel.

14. An electrical connector as recited in claim 13, wherein said means for securing the post in said channel comprises a protrusion on a cover, said protrusion adapted to extend into said channel to prevent said post from being removed therefrom when said cover is mounted on the connector housing.

15. An electrical connector as recited in claim 11, wherein said wider first region further comprises opposed side walls which are adapted to cooperate with said enlarged body section of said post to prevent rotation of said post within said channel.

16. An electrical connector as recited in claim 11, wherein said first and second channel regions include lower side wall portions which are substantially parallel to one another, said lower side wall portions of said first region cooperating with opposite sides of said enlarged body section of said post to prevent rotation of said post within said channel.

17. An electrical connector as recited in claim 11, wherein said channel includes curved surface portions for assisting in positioning said post in said channel.

18. An electrical connector as recited in claim 11, wherein said connector includes a pair of spaced channels for receiving a pair of posts therein.

* * * * *